US010234101B2

(12) United States Patent
Lee

(10) Patent No.: US 10,234,101 B2
(45) Date of Patent: Mar. 19, 2019

(54) OPTICAL DEVICE

(71) Applicant: HYUNDAI MOBIS CO., LTD., Seoul (KR)

(72) Inventor: Hyun Soo Lee, Seongnam-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 15/961,219

(22) Filed: Apr. 24, 2018

(65) Prior Publication Data

US 2018/0313518 A1 Nov. 1, 2018

(30) Foreign Application Priority Data

Apr. 27, 2017 (KR) ..... 10-2017-0054404

(51) Int. Cl.

| | |
|---|---|
| ***F21V 7/00*** | (2006.01) |
| ***F21V 7/04*** | (2006.01) |
| ***F21V 7/06*** | (2006.01) |
| ***F21S 41/141*** | (2018.01) |
| ***F21S 41/365*** | (2018.01) |
| ***F21Y 115/10*** | (2016.01) |

(52) U.S. Cl.

CPC ..... *F21V 7/0033* (2013.01); *F21V 7/0066* (2013.01); *F21V 7/041* (2013.01); *F21V 7/06* (2013.01); *F21S 41/141* (2018.01); *F21S 41/365* (2018.01); *F21Y 2115/10* (2016.08)

(58) Field of Classification Search

CPC ..... F21V 7/0033; F21V 7/06; F21V 7/0066; F21V 7/041; F21V 7/0041; F21V 7/0083; F21V 7/0025; F21S 41/141; F21S 41/365; F21Y 2115/10

See application file for complete search history.

(56) References Cited

U.S. PATENT DOCUMENTS

| | | | | |
|---|---|---|---|---|
| 7,207,705 | B2 * | 4/2007 | Ishida | F21S 43/247 362/517 |
| 7,866,863 | B2 * | 1/2011 | Tanaka | F21S 41/17 362/518 |
| 8,632,233 | B2 * | 1/2014 | Kawamura | F21V 29/70 362/539 |
| 9,664,342 | B2 * | 5/2017 | Kaiser | H01L 33/60 |
| 2002/0021508 | A1 | 2/2002 | Ishihara | |
| 2009/0284980 | A1 * | 11/2009 | Iwasaki | F21S 41/147 362/517 |
| 2010/0188854 | A1 * | 7/2010 | King | F21V 7/0025 362/296.04 |
| 2014/0098518 | A1 * | 4/2014 | Rehn | F21V 5/00 362/84 |
| 2016/0061398 | A1 | 3/2016 | Lee | |

(Continued)

FOREIGN PATENT DOCUMENTS

| | | |
|---|---|---|
| JP | 2002-055393 | 2/2002 |
| KR | 10-2016-0024483 | 3/2016 |
| KR | 10-1664710 | 10/2016 |

*Primary Examiner* — Joseph L Williams
*Assistant Examiner* — Jose M Diaz
(74) *Attorney, Agent, or Firm* — H.C. Park & Associates, PLC

(57) ABSTRACT

An optical device including: a light emitter configured to emit light rays and to converge the emitted light rays to a focus; a shield part configured to totally reflect light rays incident on the focus; and a reflector having a parabolic surface and configured to reflect light rays in parallel, the light rays being totally reflected by the shield part.

8 Claims, 5 Drawing Sheets

(56) References Cited

U.S. PATENT DOCUMENTS

| | | | | |
|---|---|---|---|---|
| 2016/0201880 | A1* | 7/2016 | Park | H01L 33/507 362/84 |
| 2017/0343179 | A1* | 11/2017 | Gurevich | F21S 41/336 |
| 2018/0023781 | A1* | 1/2018 | Park | H01L 33/50 362/84 |
| 2018/0143355 | A1* | 5/2018 | Hu | G02B 3/08 |

* cited by examiner

OPTICAL DEVICE

CROSS-REFERENCES TO RELATED APPLICATIONS

This application claims priority from and the benefit of Korean Patent Application No. 10-2017-0054404, filed on Apr. 27, 2017, which is incorporated by reference for all purposes as if fully set forth herein.

BACKGROUND

Field

Exemplary embodiments relate to an optical device, and more particularly, to an optical device capable of improving a degree of freedom in design while its size is reduced.

Discussion of the Background

In general, a vehicle has a headlamp installed at the front thereof. The headlamp has a plurality of reflective surfaces formed thereon. Light irradiated from a light source is reflected by the plurality of reflective surfaces. The headlamp is designed based on light starting from the center of the light source, and light rays starting from surfaces other than the center of the light source have a geometric difference from the design value (the light starting from the center of the light). Such a geometric difference may change the intensities or divergence angles of light rays reflected by the reflective surfaces.

When the divergence angles of the light rays have a large difference therebetween, the candela is decreased, and light spread is increased. On the other hand, when the divergence angles of the light rays have a relatively small difference therebetween, the candela is increased, and light spread is decreased.

Based on such a geometric characteristic, the optical design is conducted, and a low beam of the vehicle requires a specific candela or more and a specific spread range or more. In the headlamp, however, it is difficult to reduce the size of the reflective surface while satisfying the requirements of the low beam which requires the specific candela or more and the specific spread range or more. In order to deal with such a difficulty, a plurality of optical devices are overlapped and used.

The related art is disclosed in Korean Patent Registration No. 10-1664710 registered on Oct. 4, 2016, and entitled "Method for controlling beam pattern of headlamp".

The above information disclosed in this Background section is only for enhancement of understanding of the background of the invention and, therefore, it may contain information that does not constitute prior art.

SUMMARY

Exemplary embodiments of the present invention are directed to an optical device is capable of improving a degree of freedom in design while its size is reduced.

In one embodiment, an optical device includes: a light emitting device configured to emit light rays and converge the emitted light rays to a focus; a shield part configured to totally reflect light rays incident on the focus; and a reflector having a parabolic surface to reflect light rays in parallel, the light rays being totally reflected by the shield part.

The parabolic surface may be formed in a parabolic shape along X-axis, Y-axis, and Z-axis directions to form a focus.

The light emitting device may include: a light emitter configured to emit light; and a total reflection optic part configured to condense a focus of the light emitted from the light emitter on the shield part.

The total reflection optic part may be disposed between an end portion of the shield part and the light emitter.

The total reflection optic part may have a cone shape to form a focus by reflecting light.

The shield part may have a half-moon shaped reflecting part formed at the end portion thereof, and the focus of the light rays reflected by the total reflection optic part may be formed on the reflecting part.

The light emitter may include an LED device.

The parabolic surface may include an X-Y axis surface formed in a parabolic shape to form a focus with respect to a Y-axis, and an X-axis direction line formed in a curved shape to reflect light in parallel with a Y-Z axis surface.

The parabolic surface may include an X-Y axis surface formed in a parabolic shape to form a focus with respect to a Y-axis, and an X-axis direction line formed in a straight line or curved line shape to reflect light in parallel with a Y-Z surface.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

First, an optical device in accordance with an embodiment of the present invention will be described.

Figure 1:
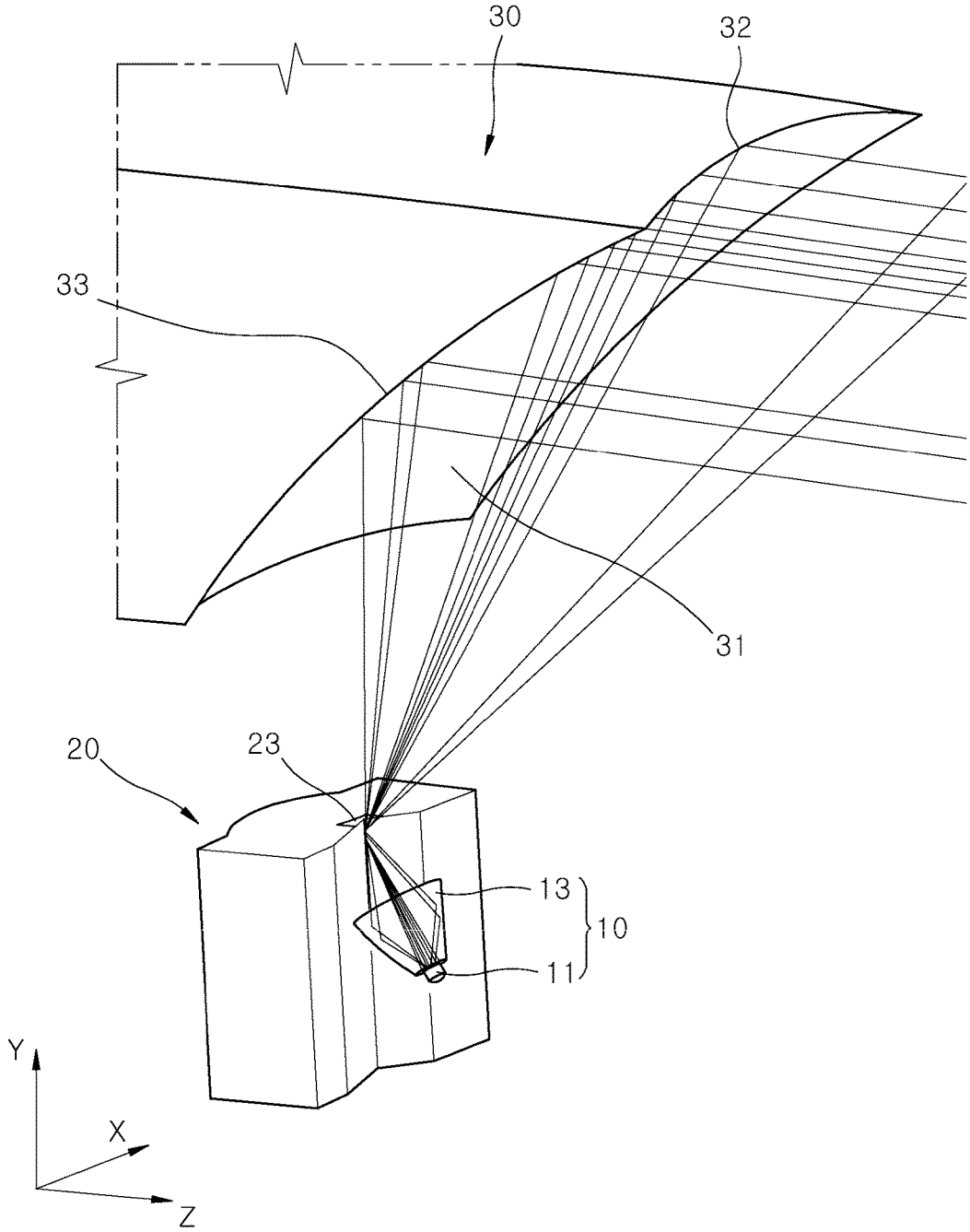
FIG. 1 is a perspective view illustrating an optical device in accordance with an embodiment of the present invention.
Figure 2:
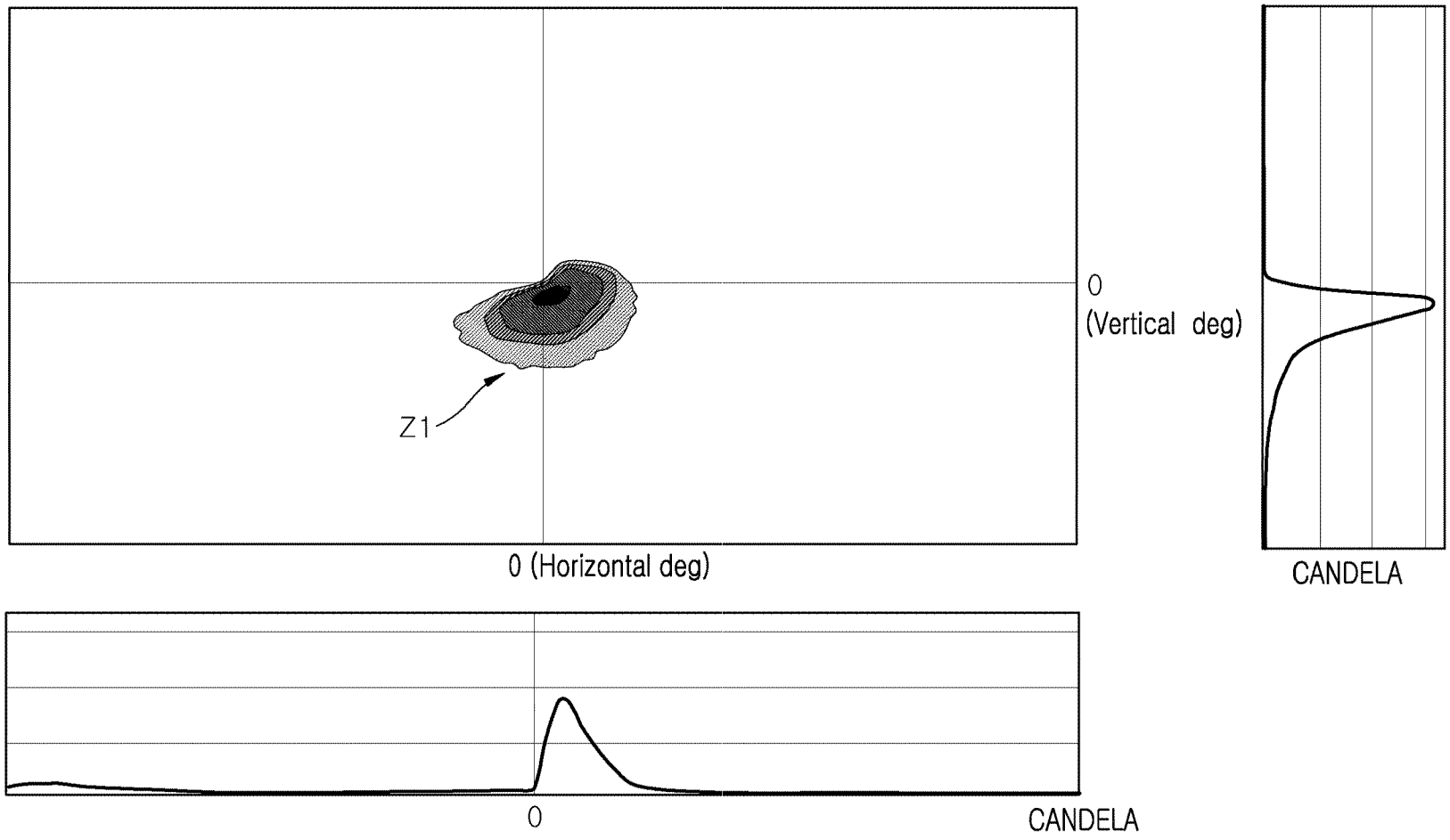
FIG. 2 illustrates a beam pattern irradiated from the optical device in accordance with the embodiment of the present invention.

FIG. 1 is a perspective view illustrating an optical device in accordance with an embodiment of the present invention, and FIG. 2 illustrates a beam pattern irradiated from the optical device in accordance with the embodiment of the present invention.

Referring to FIGS. 1 and 2, the optical device in accordance with the embodiment of the present invention may include a light emitting device 10, a shield part 20, and a reflector 30.

The light emitting device 10 may emit light rays and converge the emitted light rays to a focus. The light emitting device 10 may include a light emitter 11 and a total reflection optic part 13. The light emitter 11 may include an LED device to emit light. The total reflection optic part 13 may condense light rays which are spread and emitted from the light emitter 11, thereby forming a focus at an end portion of the shield part 20.

The total reflection optic part 13 may condense the light rays emitted from the light emitter 11 on the focus formed at the end of the shield part 20. The total reflection optic part 13 may be disposed between the end portion of the shield part 20 and the light emitter 11. The total reflection optic part 13 may have a cone shape, and form a focus by reflecting light. The total reflection optic part 13 has a reflective surface (not illustrated) formed on the inner surface thereof, in order to condense light rays on the focus.

The shield part 20 may totally reflect light rays incident on the focus. The shield part 20 may have a half moon-shaped reflecting part 23 formed at the end portion thereof, and the focus of light rays reflected by the total reflection optic part 13 may be formed on the reflecting part 23 of the shield part 20. The reflecting part 23 may be formed to have various shapes.

The reflector 30 may have a parabolic surface 31 to reflect the light rays totally-reflected by the shield part 20 in parallel with each other. The parabolic surface 31 may be formed in a parabolic shape along the X-axis, Y-axis and Z-axis directions to form a focus. That is, the parabolic surface 31 may include an X-axis direction line 32 formed in a parabolic shape, a Y-axis direction line 33 formed in a parabolic shape, and a Z-axis direction line (not illustrated) formed in a parabolic shape.

The light rays reflected from the focus of the shield part 20 may be incident at various angles on the parabolic surface 31. At this time, since the X-axis direction line 32, the Y-axis direction line 33, and the Z-axis direction line of the parabolic surface 31 are all formed in a parabolic shape, the reflection angles of all light rays on the parabolic surface 31 are parallel to each other. That is, the reflection angles of all light rays may be parallel to the Z-axis as illustrated in FIG. 1.

Since the light rays are reflected in parallel with each other through the parabolic surface 31, a cut-off line along which the light rays may be concentrated on a hot zone Z1 may be formed. Since the light rays are concentrated on the hot zone Z1, the light rays can satisfy requirements of a low beam which requires a specific candela or more and a specific spread range or more.

Furthermore, since various angles of light rays are reflected through one parabolic surface 31, the degree of freedom in design can be improved while the size of the reflective surface can be reduced.

Next, an optical device in accordance with another embodiment of the present invention will be described.

Figure 3:
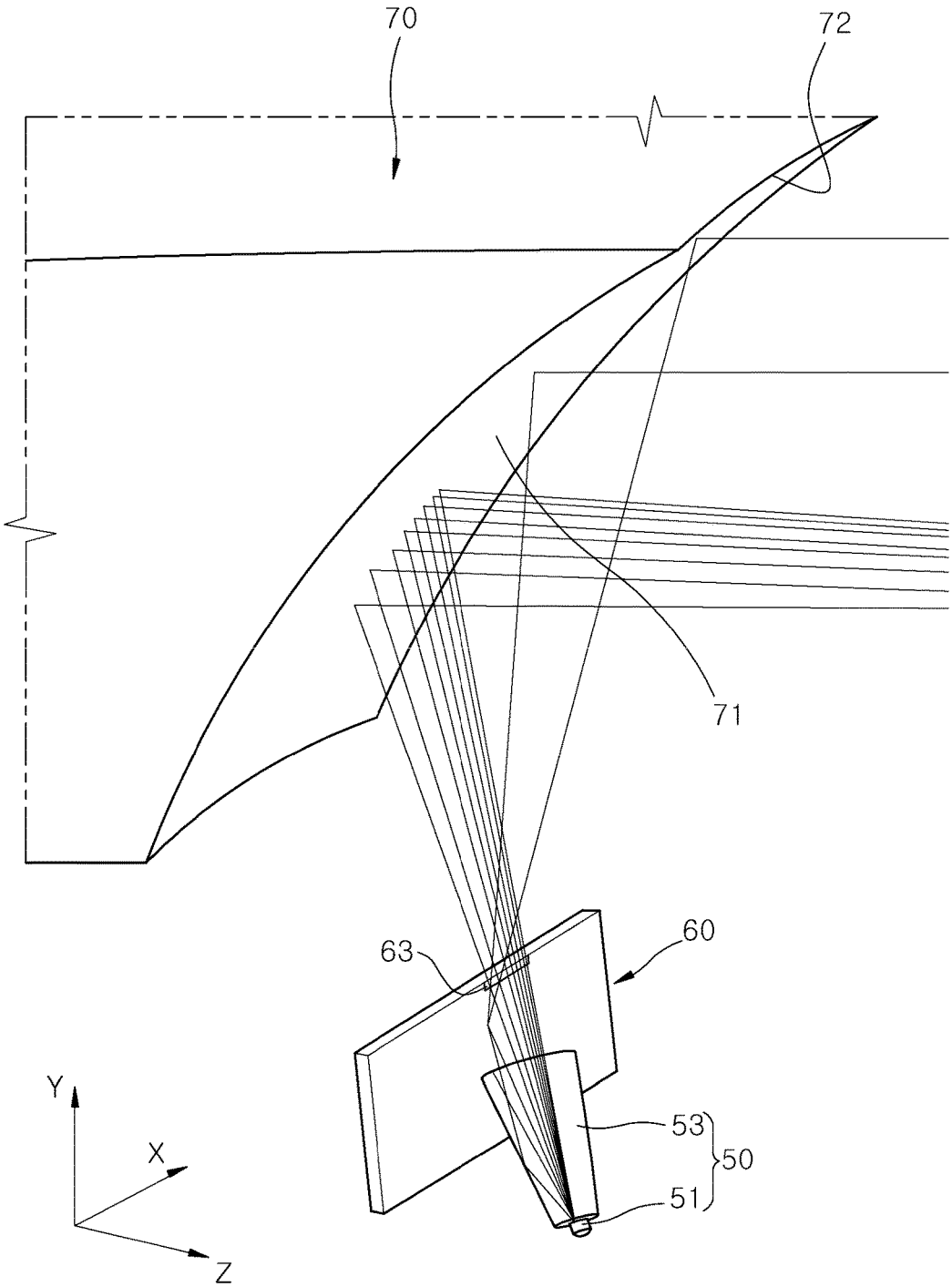
FIG. 3 is a perspective view illustrating an optical device in accordance with another embodiment of the present invention.
Figure 4:
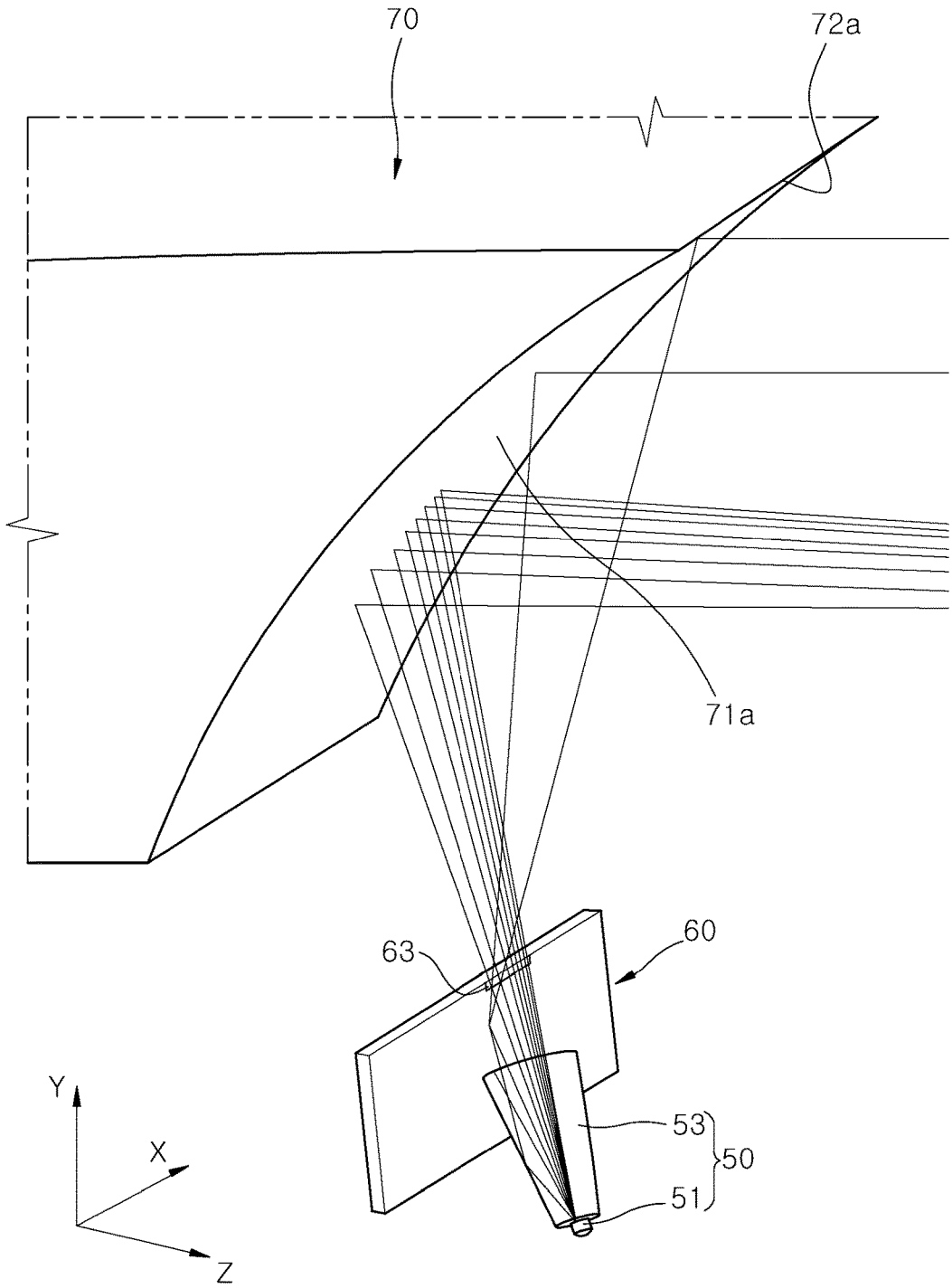
FIG. 4 is a perspective view illustrating an optical device in accordance with still another embodiment of the present invention.
Figure 5:
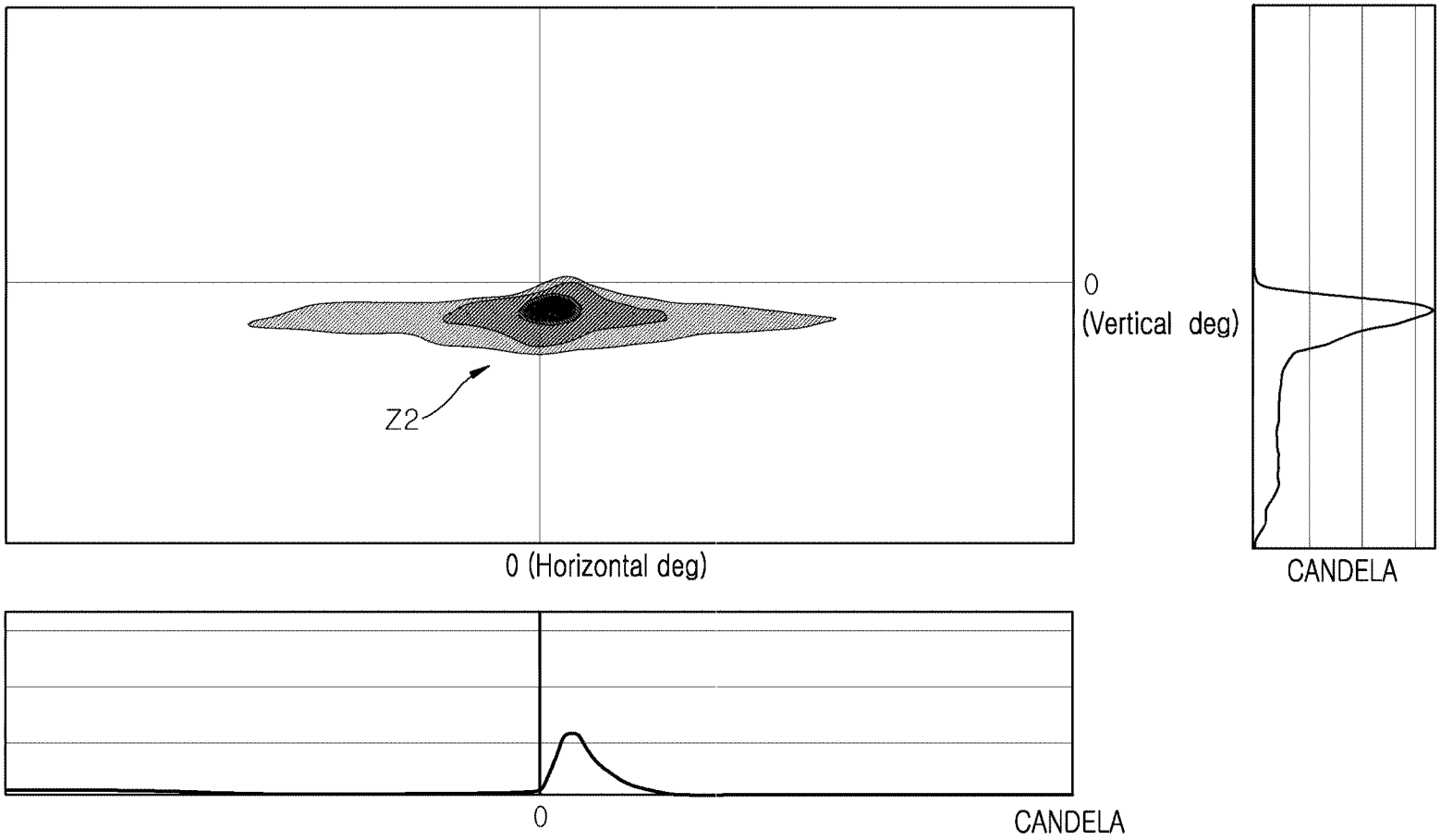
FIG. 5 illustrates a beam pattern irradiated from the optical device in accordance with the embodiment of the present invention.

FIG. 3 is a perspective view illustrating an optical device in accordance with another embodiment of the present invention, FIG. 4 is a perspective view illustrating an optical device in accordance with still another embodiment of the present invention, and FIG. 5 illustrates a beam pattern irradiated from the optical device in accordance with the embodiment of the present invention.

Referring to FIGS. 3 and 5, the optical device in accordance with the embodiment of the present invention may include a light emitting device 50, a shield part 60 and a reflector 70.

The light emitting device 50 may emit light rays and converge the emitted light rays to a focus. The light emitting device 50 may include a light emitter 51 and a total reflection optic part 53. The light emitter 51 may include an LED device to emit light.

The total reflection optic part 53 may condense light rays on a straight line on the X-Z axis plane, the light rays being spread and emitted from the light emitter unit 51, thereby forming a focus line at an end portion of the shield part 60. The total reflection optic part 53 has a reflective surface (not illustrated) formed on the inner surface thereof, in order to condense light rays on the focus line on the X-Z axis plane.

The shield part 60 may totally reflect light rays incident on the focus light. The shield part 60 may have an elongated reflecting part 63 formed at a corner thereof, and the focus line of the light rays reflected by the total reflection optic part 53 may be formed on the reflecting part 63 of the shield part 60.

The reflector 70 may have a parabolic surface 71 to reflect the light rays that are totally reflected by the shield part 60 in parallel with each other.

The parabolic surface 71 may include an X-Y axis surface formed in a parabolic shape to form a focus with respect to the Y-axis, and an X-axis direction line 72 formed in a curved shape to reflect light in parallel with a Y-Z axis surface (refer to FIG. 3). The light rays reflected from the focus of the shield part 60 may be incident on the parabolic surface 71.

In another embodiment, the parabolic surface 71 may include an X-Y axis surface formed in a parabolic shape to form a focus with respect to the Y-axis, and an X-axis direction line 72*a* formed in a straight line or curved line shape to reflect light rays in parallel with a Y-Z axis surface (refer to FIG. 4). The light rays reflected from the focus of the shield part 60 may be incident on the parabolic surface 71.

At this time, since the X-Y axis surface of the parabolic surface 71, corresponding to the vertical direction, is formed in a parabolic shape, a focus of vertical straight line light may be formed on the parabolic surface 71.

Furthermore, since the line 72 or 72*a* of the parabolic surface 71, parallel to the X-axis, is formed in a straight line or curved line shape, horizontal straight line light rays may be reflected in parallel with the Y-Z axis plane. Therefore, light ray spread may occur on the line of the parabolic surface 71, parallel to the X-axis.

On the parabolic surface 71, the vertical straight line light rays may form a focus, and the horizontal straight line light rays may spread. Thus, a cut-off line may be concentrated on a spread zone Z2, which has a small width in the Y-axis direction and a long length in the X-axis direction. At this time, the candela may be concentrated on the center of the spread zone Z2. Since the light rays are concentrated on the spread zone Z2, the light rays can satisfy the requirements of a low beam which requires a specific candela or more and a specific spread range or more.

Furthermore, since various angles of light rays are reflected through one parabolic surface 71, it is possible to improve the degree of freedom in design while the size of the reflective surface can be reduced.

In accordance with the embodiments of the present invention, since light is reflected in parallel by the parabolic surface, a cut-off line along which light is concentrated on a hot zone may be formed. Since light is concentrated on the hot zone, the light can satisfy a specific candela or more and a specific spread range or more.

Furthermore, since various angles of light rays are reflected through one parabolic surface, the degree of freedom in design can be improved while the size of the reflective surface can be reduced Although exemplary embodiments of the invention have been disclosed for illustrative purposes, those skilled in the art will appreciate that various modifications, additions and substitutions are possible, without departing from the scope and spirit of the invention as defined in the accompanying claims.

What is claimed is:

1. An optical device comprising:

a light emitting device configured to emit light rays and converge the emitted light rays to a focus, the light emitting device comprising:

a light emitter configured to emit light; and a total reflection optic part configured to condense a focus of the light emitted from the light emitter onto the shield part;

a shield part configured to totally reflect light rays incident on the focus; and a reflector having a parabolic surface configured to reflect light rays in parallel, the light rays being totally reflected by the shield part.

2. The optical device of claim 1, wherein the parabolic surface has a parabolic shape along an X-axis direction, a Y-axis direction, and a Z-axis direction to form a focus.

3. The optical device of claim 1, wherein the total reflection optic part is disposed between an end portion of the shield part and the light emitter.

4. The optical device of claim 3, wherein the total reflection optic part has a cone shape to form a focus by reflecting light.

5. The optical device of claim 3, wherein the shield part has a half-moon shaped reflecting part formed at the end portion thereof, and the focus of the light reflected by the total reflection optic part is formed on the reflecting part.

6. The optical device of claim 1, wherein the light emitter comprises an LED device.

7. The optical device of claim 1, wherein the parabolic surface comprises an X-Y axis surface formed in a parabolic shape to form a focus with respect to a Y-axis, and an X-axis direction line formed in a curved shape to reflect light in parallel with a Y-Z axis surface.

8. The optical device of claim 1, wherein the parabolic surface comprises an X-Y axis surface formed in a parabolic shape to form a focus with respect to a Y-axis, and an X-axis direction line formed in a straight line or curved line shape to reflect light in parallel with a Y-Z surface.

* * * * *